United States Patent [19]

Kaffenberger

[11] 3,988,702

[45] Oct. 26, 1976

[54] WAVEGUIDE SECTION FOR CONNECTING RECTANGULAR WAVEGUIDE WITH ELLIPTICAL WAVEGUIDE

[75] Inventor: Ernst Kaffenberger, Backnang, Germany

[73] Assignee: Licentia Patent-Verwaltungs-G.m.b.H., Frankfurt am Main, Germany

[22] Filed: June 2, 1975

[21] Appl. No.: 582,923

[30] Foreign Application Priority Data

June 1, 1974 Germany ..... 2426699
Aug. 10, 1974 Germany ..... 2438504

[52] U.S. Cl. ..... 333/33; 333/21 R; 333/98 R

[51] Int. Cl.[2] ..... H01P 5/08

[58] Field of Search ..... 333/21 R, 33, 98 R

[56] References Cited

UNITED STATES PATENTS

| | | | |
|---|---|---|---|
| 3,388,352 | 6/1968 | Ramonat | 333/98 R |
| 3,686,595 | 8/1972 | Spinner | 333/21 R X |
| 3,720,890 | 3/1973 | Anderson | 333/98 R |
| 3,928,825 | 12/1975 | Kaffenberger et al. | 333/98 R X |

FOREIGN PATENTS OR APPLICATIONS

| | | | |
|---|---|---|---|
| 1,244,886 | 7/1967 | Germany | 333/21 R |

*Primary Examiner*—Paul L. Gensler
*Attorney, Agent, or Firm*—Spencer & Kaye

[57] ABSTRACT

A connecting piece for connecting a rectangular waveguide with an elliptical waveguide is composed of a waveguide section having a rectangular cross section identical to that of the rectangular waveguide to be connected, the waveguide section being provided, in the center of at least one of its wide sides, with a cylindrical recess at a distance of ⅛ of the waveguide wavelength with respect to the center of its longitudinal dimension from the plane of connection with the elliptical waveguide, the length of the recess in the longitudinal direction of the waveguide section being less than ¼ such wavelength and the depth of the recess being selected in dependence on its length to match the two connected waveguides over a broad frequency band.

16 Claims, 2 Drawing Figures

WAVEGUIDE SECTION FOR CONNECTING RECTANGULAR WAVEGUIDE WITH ELLIPTICAL WAVEGUIDE

BACKGROUND OF THE INVENTION

The present invention relates to a connecting piece including a waveguide section for connecting a rectangular waveguide and a waveguide with an approximately elliptical cross section.

Waveguides with an approximately elliptical cross section have recently found acceptance in practice. These waveguides are designed either as rigid waveguides or as semiflexible waveguides and are constituted by either smooth or corrugated hollow tubes. To connect such a waveguide with an approximately elliptical inner cross section to the normally used standard rectangular waveguides, it is necessary to use an appropriately designed transition piece. This transition piece must have such dimensions that it provides a connection which produces as little reflection as possible over a relatively wide frequency range.

For this purpose it is known to widen the inner cross section of a rectangular waveguide over a length of about ¾ $\lambda_g$, $\lambda_g$ being the guide wavelength $$(\lambda_g = \sqrt{\frac{1-\lambda_o}{\lambda_c}})$$

of the energy to be propagated therein, in the direction toward the elliptical waveguide so that the desired transition is produced in conjunction with additional matching elements. A stepwise enlargement of the rectangular cross section in the direction toward the larger elliptical cross section is also known.

Such transitions, however, are extremely expensive to produce because they require a complicated manufacturing process and they are not suited for mass production. This also applies for waveguide transition pieces having an approximately conical shape in which one or a plurality of recesses are cut in the area of the transition to attempt to produce matching without additional adjustable matching elements.

SUMMARY OF THE INVENTION

It is therefore an object of the present invention to provide a waveguide section for connecting a rectangular waveguide with an elliptical waveguide which can be produced very inexpensively and which nevertheless assures the required electrical properties.

Based on the above-described arrangement, the objects according to the present invention are achieved by a waveguide connecting section provided with an inner cross section which is identical to the rectangular waveguide section to be connected and provided with a cylindrical recess in the center of at least one of its wide sides at a distance of ⅛ $\lambda_g$ from the plane of connection with the elliptical waveguide, the length of this cylindrical recess in the longitudinal direction of the waveguide section being less than ¼ $\lambda_g$ and its depth being selected, in dependence on its longitudinal length, so that the two waveguides to be connected can be matched over a broad band.

DESCRIPTION OF THE PREFERRED EMBODIMENT

Figure 1:
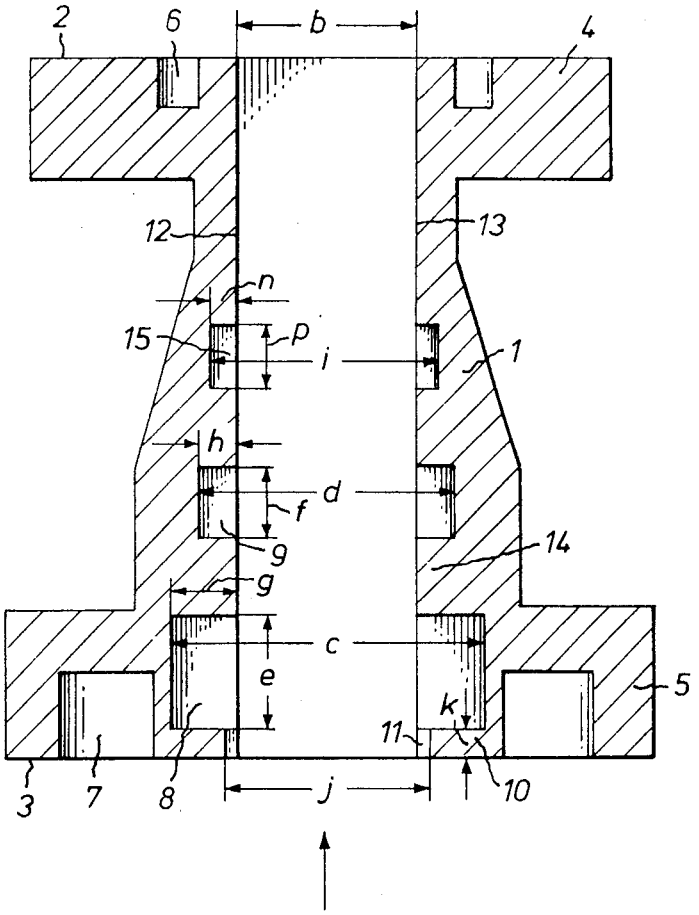
FIG. 1 is a longitudinal cross-sectional view of a preferred embodiment of a waveguide connecting piece according to the invention.
Figure 2:
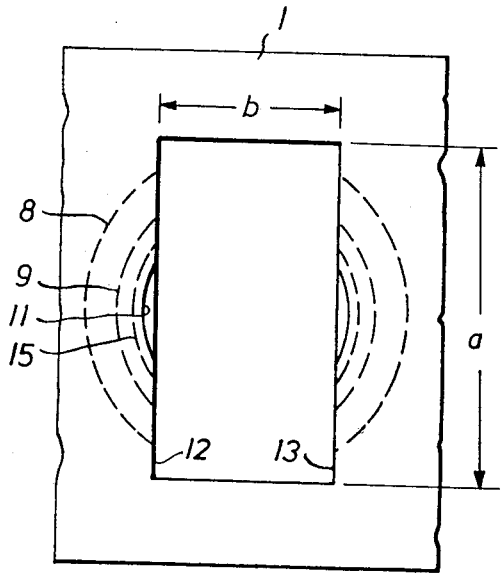
FIG. 2 is an end view in the direction of the arrow in FIG. 1.

The connecting piece which is shown in FIGS. 1 and 2 includes a waveguide section 1 having a rectangular inner cross section. Its narrow sides have the transverse dimension *b*. Its wide sides are normal to the plane of FIG. 1. At both longitudinal ends, the waveguide section 1 is provided with flanges for connection to adjacent waveguides. At the end of the piece appearing at the top of FIG. 1, a rectangular waveguide (not shown) is flanged on in a known manner via the plane of connection 2. The flange 4 provided for this purpose has a recess 6 for the insertion of an appropriate gasket. At the end of the illustrated waveguide section 1 appearing at the bottom of FIG. 1, a waveguide with an approximately elliptical inner cross section is flanged on in the plane of connection 3 by means of flange 5. A recess 7 serves to accommodate the appropriate gasket.

In the center of each of the two wide sides 12 and 13 of waveguide section 1, a respective recess 8 is provided with its longitutinal center at a distance of about ⅛ $\lambda_g$ from the plane of connection 3. The length e of this recess, in the longitudinal direction of the waveguide section, is less than ¼ $\lambda_g$, and its depth g is selected, in dependence on the value of its longitudinal extent, so that the two waveguides to be connected are matched over a broad band.

According to a further feature of the invention, the waveguide section 1 has further recesses 9 provided with their longitutinal centers, at a distance of about ⅝ $\lambda_g$ ⅝ $\lambda_g$ or ⅞ $\lambda_g$ from the plane of connection 3, recesses 9 having a depth *h*, and corresponding diameter *d*, which is less than depth *g*, and corresponding diameter *c*, of recesses 8 and a longitudinal extent *f* which is less than ¼ $\lambda_g$. The two pairs of recesses 8 and 9 are separated from one another by a waveguide partial section 14 having a constant rectangular cross section.

In the illustrated embodiment there is additionally provided a waveguide partial section 10 of a length of no more than 1/16 $\lambda_g$ between the plane of connection 3 with the elliptical waveguide and the recesses 8. The cross section of this partial waveguide section 10 is provided at the center of its wide sides with circular cylindrical recesses 11 which together have a diameter j less than the diameter c of the recesses 8. The length *k* of the partial waveguide section 10 is substantially determined by mechanical considerations dependent on the elliptical waveguide to be connected.

In order to facilitate fabrication, it is recommended to make each recess in the form of a segment of a circular cylinder. For the same reason, the recesses 8 provided at a distance of about ⅛ $\lambda_g$ from the plane of connection 3 should be arranged in symmetry with respect to the longitudinal axis of the waveguide section 1 and should be identical to one another. The same considerations also apply to recesses 9 in the two wide sides 12 and 13 of waveguide section 1. If these recesses are arranged in symmetry with the longitudinal axis of the waveguide and have the same configuration, these recesses can be produced in a simple manner in a cylindrical configuration with a suitably dimensioned cutting tool to obtain the desired diameter d and the required length *f* for the recess 9.

Extremely broadbanded matching of the arrangement is attained by a further feature of the invention involving provision of a further recess 15 in at least one of the two wide sides of the waveguide section 1. The distance of longitutinal centers of that recess 15 from the plane of connection 3 is about ⅝ $\lambda_g$, in which case recesses 9 will have their longitudinal centers spaced ⅜ $\lambda_g$ from plane 3. The longitudinal extent p of recess 15 and its depth *n*, or its diameter *i* if a corresponding recess 15 is disposed in each wide side 12 and 13, are made smaller than the corresponding dimensions *f* and *h* or *d*, respectively, of recesses 9. The exact values of the given dimensions *n* or *i* and *p*, respectively, are determined in a known manner by way of measurements.

The present invention thus permits broadbanded matching of two waveguides with different cross sections with the aid of an interposed waveguide section which has an inner cross section corresponding to the rectangular waveguide to be connected and can thus be produced very simply. Moreover, the waveguide section is shorter than comparable conventional transition pieces.

The dimensions of one embodiment of the invention with respect to the figures are as follows:

| | |
|---|---|
| the broadside of the waveguide section | a = 34.85 mm, |
| the narrow side b of the waveguide section | b = 15.80 mm, |
| the diameter of recess 8 | c = 26.00 mm, |
| the diameter of the recess 9 | d = 23.60 mm, |
| the diameter i was choosen as | i = 20.00 mm, |
| the length of recess 8 | e = 10.95 mm, |
| the length of recess 9 | f = 12.15 mm, |
| the length of recess 15 | p = 9.35 mm, |
| the length k is | k = 2.65 mm, |
| the diameter j is | j = 18.00 mm; |

the recesses 8, 9 and 15 are nearly symmetrically built up and therefore $$g = \frac{c-b}{2}$$

$$h = \frac{d-b}{2}$$

$$n = \frac{i-b}{2}.$$

The connecting device as above described has a VSWR less than 1,02 in the working frequency range from 5.9 GHz to 7.2 GHz. The elliptical waveguide connected therewith has a maximum diameter of 44.5 mm and a minimum diameter of 23.5 mm.

It will be understood that the above description of the present invention is susceptible to various modifications, changes and adaptations, and the same are intended to be comprehended within the meaning and range of equivalents of the appended claims.

What is claimed is:

1. A connecting device comprising a waveguide section for connecting a rectangular waveguide with a waveguide having an approximately elliptical cross section, wherein said waveguide section has an inner cross section which is identical to that of the rectangular waveguide to be connected and is provided at the center of one of its wide sides, at a distance of about ⅛ $\lambda_g$ from the plane of connection with the elliptical waveguide, where $\lambda_g$ is the waveguide wavelength, with a first recess having the form of a portion of a cylinder, having a length, in the longitudinal direction of said waveguide section, less than ¼ $\lambda_g$, and having a depth which is related to its length in a manner such that the two waveguides to be connected will be matched over a broad band.

2. An arrangement as defined in cliam 1 wherein said first recess has the form of a segment of a circular cylinder.

3. An arrangement as defined in claim 1 wherein each wide side of said waveguide section is provided with a respective first recess.

4. An arrangement as defined in claim 3 wherein the two said first recesses are located symmetrically to the axis of said waveguide section and are identical to one another in shape and dimensions.

5. Arrangement as defined in claim 1 wherein at least one of the wide sides of said waveguide section is provided with an additional recess at a distance of about ⅜ $\lambda_g$, ⅝ $\lambda_g$ or ⅞ $\lambda_g$ from the plane of connection with the elliptical waveguide, the depth of said additional recess being less than the depth of said first recess and the length of said additional recess being less than ¼ $\lambda_g$, and said waveguide section includes a waveguide partial section of constant rectangular cross section located between, and separating, said first recess and said additional recess.

6. An arrangement as defined in claim 5 wherein each said recess has the form of a segment of a circular cylinder.

7. An arrangement as defined in claim 5 wherein each wide side of said waveguide section is provided with a respective first recess and a respective additional recess.

8. An arrangement as defined in claim 7 wherein said first recesses in said two wide sides of said waveguide section form a first pair of recesses and said additional recesses in said two wide sides of said waveguide section form a second pair of recesses, and the said recesses of each said pair are located symmetrically to the axis of said waveguide section and are identical to one another in shape and dimensions.

9. An arrangement as defined in claim 5 wherein at least one of the wide sides of said waveguide section is provided with a further recess at a distance of ⅝ $\lambda_g$ from the plane of connection with the elliptical waveguide, the depth and length of said further recess being less than the corresponding dimensions of said additional recess.

10. An arrangement as defined in claim 9 wherein each said recess has the form of a segment of a circular cylinder.

11. An arrangement as defined in claim 9 wherein each wide side of said waveguide section is provided with a respective first recess, a respective additional recess, and a respective further recess.

12. An arrangement as defined in claim 10 wherein said first recesses, said additional recesses and said further recesses in said two wide sides of said waveguide section form three respective pairs of recesses and said recesses of each said pair are located symmetrically to the axis of said waveguide section and are identical to one another in shape and dimensions.

13. An arrangement as defined in claim 1 wherein said waveguide section comprises a partial waveguide section having a length of no more than $1/16\ \lambda_g$ and disposed between the plane of connection with the elliptical waveguide and said first recess, each wide side of said partial waveguide section being provided with a respective recess having the form of a portion of a cylinder, the recesses in both said wide sides of said partial waveguide section defining parts of a single cylinder and each having a depth less than that of said first recess.

14. An arrangement as defined in claim 13 wherein said first recess has the form of a segment of a circular cylinder.

15. An arrangement as defined in claim 13 wherein each wide side of said waveguide section is provided with a respective first recess.

16. An arrangement as defined in claim 15 wherein the two said first recesses are located symmetrically to the axis of said waveguide section and are identical to one another in shape and dimensions.

* * * * *